US009671815B2

(12) United States Patent
Fuller et al.

(10) Patent No.: US 9,671,815 B2
(45) Date of Patent: Jun. 6, 2017

(54) ELECTRONIC THROTTLE CONTROL PEDAL ASSEMBLY

(71) Applicant: KSR IP Holdings, LLC, Ridgetown (CA)

(72) Inventors: Shaun Matthew Fuller, Ridgetown (CA); Dan O'Neill, Chatham (CA)

(73) Assignee: KSR IP Holdings, LLC, Wilmington, DE (US)

( * ) Notice: Subject to any disclaimer, the term of this patent is extended or adjusted under 35 U.S.C. 154(b) by 234 days.

(21) Appl. No.: 14/505,572

(22) Filed: Oct. 3, 2014

(65) Prior Publication Data

US 2015/0096407 A1 Apr. 9, 2015

Related U.S. Application Data

(60) Provisional application No. 61/886,115, filed on Oct. 3, 2013.

(51) Int. Cl.

| | |
|---|---|
| ***G05G 1/30*** | (2008.04) |
| ***G05G 5/03*** | (2008.04) |
| ***G05G 1/44*** | (2008.04) |

(52) U.S. Cl.

CPC ..... *G05G 1/44* (2013.01); *G05G 5/03* (2013.01); *Y10T 74/20534* (2015.01)

(58) Field of Classification Search

CPC ... G05G 1/38; G05G 1/44; G05G 5/03; Y10T 74/20534; B60K 26/021; B60T 7/04

See application file for complete search history.

(56) References Cited

U.S. PATENT DOCUMENTS

| | | | | |
|---|---|---|---|---|
| 7,216,563 | B2 * | 5/2007 | Willemsen | G05G 1/38 74/512 |
| 7,750,258 | B2 * | 7/2010 | Lee | B60K 26/021 200/61.89 |
| 7,793,566 | B2 * | 9/2010 | Ypma | G05G 1/38 74/513 |
| 8,161,842 | B2 * | 4/2012 | Kim | B60K 26/021 74/513 |
| 8,434,385 | B2 * | 5/2013 | Mo | G05G 1/506 74/512 |

(Continued)

FOREIGN PATENT DOCUMENTS

| | | | |
|---|---|---|---|
| KR | 1020080008028 | A | 1/2008 |
| KR | 100841924 | B1 | 6/2008 |

*Primary Examiner* — Adam D Rogers
(74) *Attorney, Agent, or Firm* — Dinsmore & Shohl LLP

(57) ABSTRACT

A pedal assembly having a hysteresis creating configuration in communication with a sensor of a pedal assembly. The assembly includes a housing and a pedal arm wherein the pedal arm is pivotally mounted by bushings to the housing. A connector and sensor assembly is provided connected through the pivot point (hub) where the pedal arm connects to the housing of the pedal assembly. A spring connects to a spring carrier wherein the spring is depressed upon depression of the pedal arm of the pedal assembly. As the spring applies a force to the spring carrier, the spring carrier slides down an inclined wall and applies a force to a friction shoe. The friction shoe is in contact with the generally circular hub of the pedal arm thus providing a hysteresis effect as the friction shoe contacts the hub of the pedal arm.

21 Claims, 7 Drawing Sheets

(56) References Cited

U.S. PATENT DOCUMENTS

| | | | | |
|---|---|---|---|---|
| 8,528,443 | B2 * | 9/2013 | Campbell | B60K 26/021 74/513 |
| 8,534,157 | B2 * | 9/2013 | O'Neill | G05G 1/30 74/512 |
| 8,726,759 | B2 * | 5/2014 | Mannle | G05G 1/38 74/512 |
| 2006/0185469 | A1 * | 8/2006 | Schlabach | G05G 1/38 74/560 |
| 2008/0276749 | A1 * | 11/2008 | Stewart | G05G 1/38 74/512 |
| 2013/0133473 | A1 * | 5/2013 | Kim | B60K 26/02 74/567 |

* cited by examiner

ELECTRONIC THROTTLE CONTROL PEDAL ASSEMBLY

CROSS-REFERENCE TO RELATED APPLICATIONS

This utility patent application claims priority from U.S. provisional patent application Ser. No. 61/886,115, filed Oct. 3, 2013, the entire contents of which is incorporated herein in its entirety.

FIELD OF THE INVENTION

This invention relates generally to pedal assemblies. More particularly, this invention relates to pedal assemblies having hysteresis characteristics and sensors incorporated into the pedal arm hub for measuring rotation.

BACKGROUND OF THE INVENTION

Electronic throttle control (ETC) pedal assemblies are more commonly used in the art to provide accurate pedal control in pedal, assemblies. It is known to use pedal assemblies having position sensors to produce a pedal assembly for vehicle control such as brake and throttle operation. A significant drawback of these pedal assemblies is the removal of the physical connection of the pedal to the vehicle control. This removes the resistance or pedal feel that the driver typically is accustomed to during vehicle operation. These ETC pedal assemblies do not feel like traditional pedal assemblies when depressed by the user. Accordingly, there exists a need in the art to provide an ETC pedal having improved hysteresis characteristics to provide the feel of a traditional pedal assembly to the user of the vehicle.

SUMMARY OF THE INVENTION

A pedal assembly having a hysteresis creating configuration in communication with a sensor of a pedal assembly. The assembly includes a housing and a pedal arm wherein the pedal arm is pivotally mounted by bushings to the housing. A connector and sensor assembly is provided connected through the pivot point where the pedal arm connects to the housing of the pedal assembly. A spring connects to a spring carrier wherein the spring is depressed upon depression of the pedal arm of the pedal assembly. As the spring applies a force to the spring carrier, the spring carrier slides down an inclined wall and applies a force to a friction shoe. The friction shoe is in contact with the generally circular hub of the pedal arm thus providing a hysteresis effect as the friction shoe contacts the hub of the pedal arm. The assembly also provides for the hub of the pedal assembly having a sensor incorporated therein.

BRIEF DESCRIPTION. OF THE DRAWINGS

DETAILED DESCRIPTION OF THE INVENTION

Figure 1:
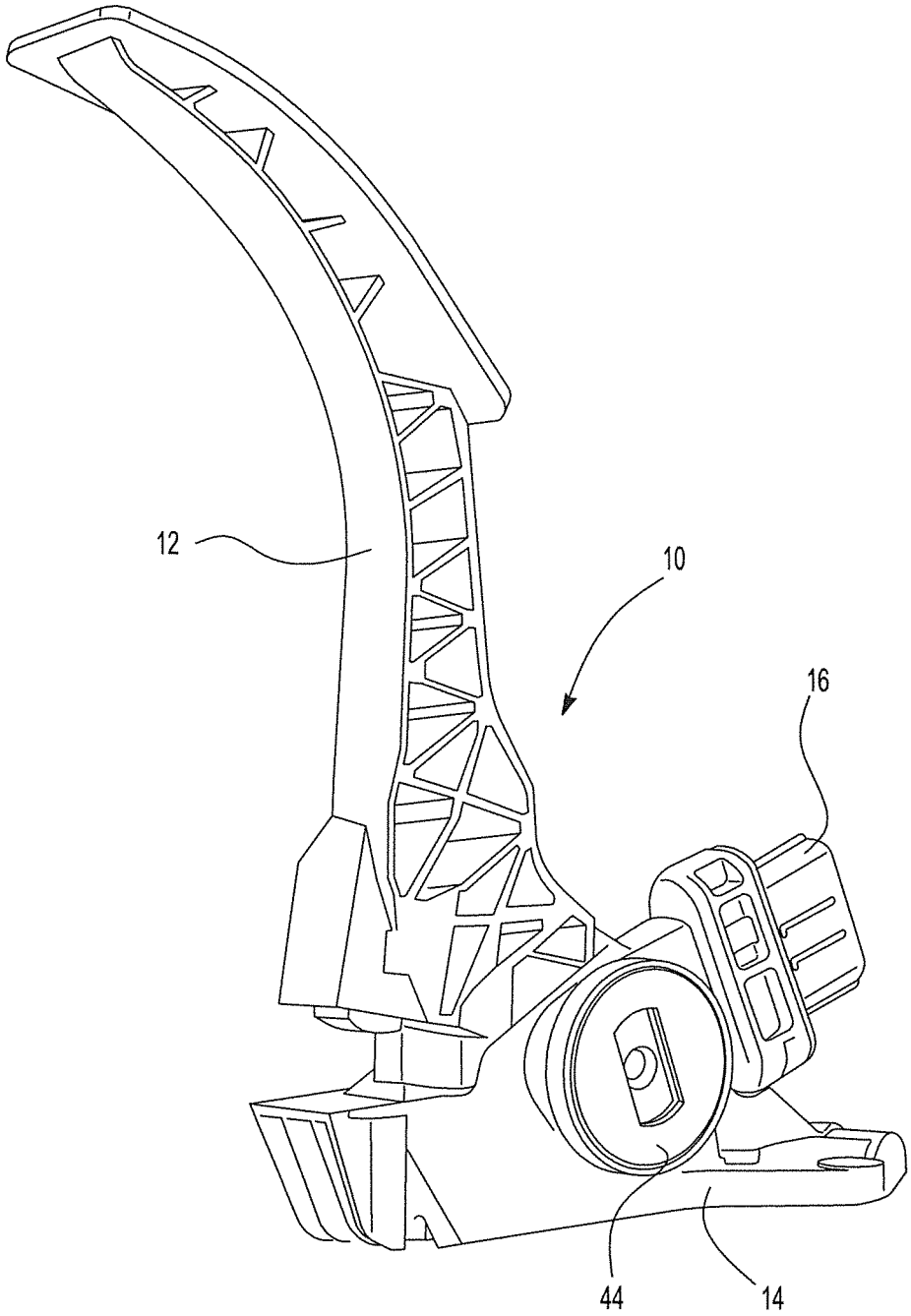
FIG. 1 illustrates a perspective of the pedal assembly in the housing of the present invention.

The present invention provides for an electronic throttle control (ETC) pedal assembly 10 having a hysteresis subassembly. The assembly includes a housing 14 and a pedal arm 12 wherein the pedal arm 12 is pivotally mounted by bushings to the housing 14. The hysteresis subassembly 15 includes at least one spring 45, a spring carrier 22 and a friction shoe 24 where the friction shoe 24 is in contact with the pedal arm 12 thereby providing hysteresis. As the pedal arm 12 is depressed, the spring displaces the spring carrier along an angled wall which in turn pushes the friction shoe against the pedal arm as the pedal arm continues to rotate thereby creating friction and thus creating hysteresis between the angled surface and the spring carrier and between the friction shoe and the pedal arm. The pedal assembly includes a rotation (or hysteresis) sensor incorporated into the connection (or rotation) point (or hub) of the pedal arm where the pedal arm connects to the housing. A connector and sensor assembly is provided connected through the pivot point where the pedal arm connects to the housing of the pedal assembly. The present invention incorporates a molded plastic pedal arm and molded plastic housing allowing for the housing to include an indention (or compartment) for accepting the at least one spring of the hysteresis subassembly. The new method of manufacturing (molding) further allows for the sensor to be incorporated into the rotation point of the pedal arm where the pedal arm is in contact with the housing. This significant advantage allows for reduced cost and space (reducing packaging) thus providing for a significant improvement.

The pedal assembly 10 includes a pedal arm 12 mounted to a housing 14 through bushings. A connector 16 having a plurality of pins 17 is also provided indirectly connected to the pedal arm 12 and the housing 14 through the molded aperture 60 configured to accept the connector 16. The connector 16 is operable to hold a sensor, specifically a rotary sensor. The connector 16 and the sensor, although not directly connected to the housing, share the same pivot axis. The pedal arm 12 is pivotally connected to the housing 14. The pedal arm 12 includes a spring or damper mounting area 18 operable to hold a spring or a damper. The pedal arm 12 further includes a kick down button 28 having a spring 30. The kick down button 28 is operable to contact the generally planar surface 29 of the housing 14. The button 28 is in contact with an ECU of the button contacts the surface 29. If the button 28 contacts the surface 29 and the spring 30 is depressed, a signal is sent to the ECU to indicate that the pedal has been depressed to its full capacity (i.e. pedal to the metal position). The ECU is then capable of controlling the pedal system to either increase braking or acceleration.

Figure 7:
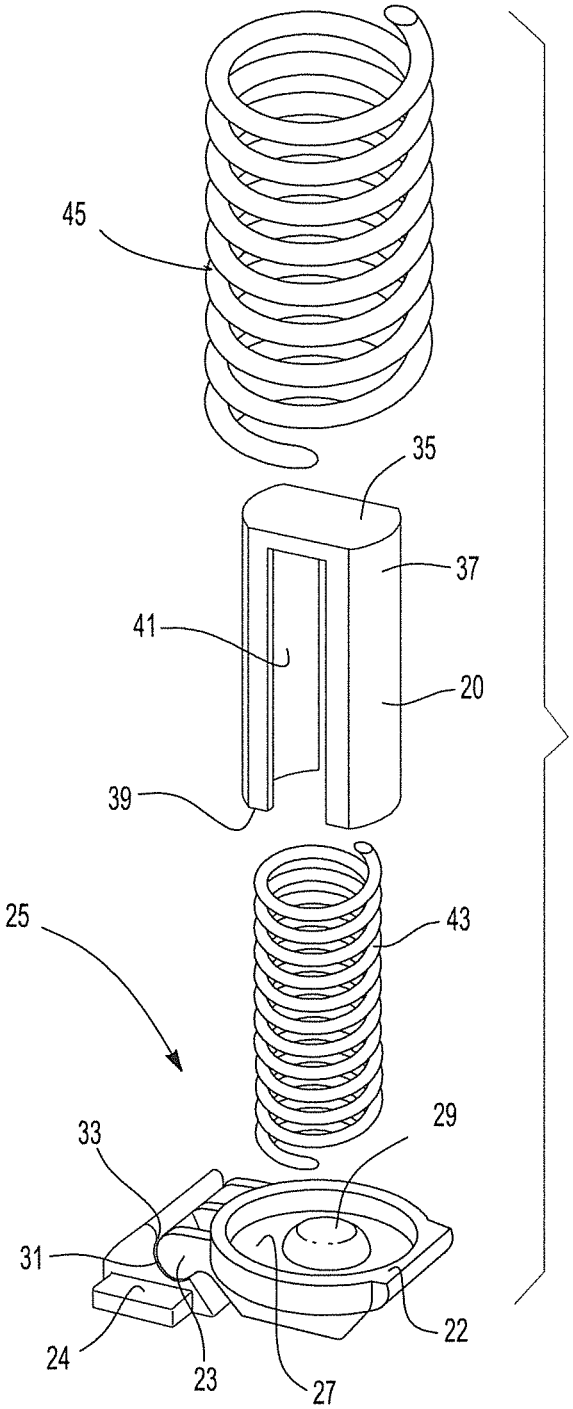
FIG. 7 illustrates a perspective view of the spring carrier, spring, spring housing and friction shoe mounted to the pedal arm of the pedal assembly of the present invention.
Figure 8:
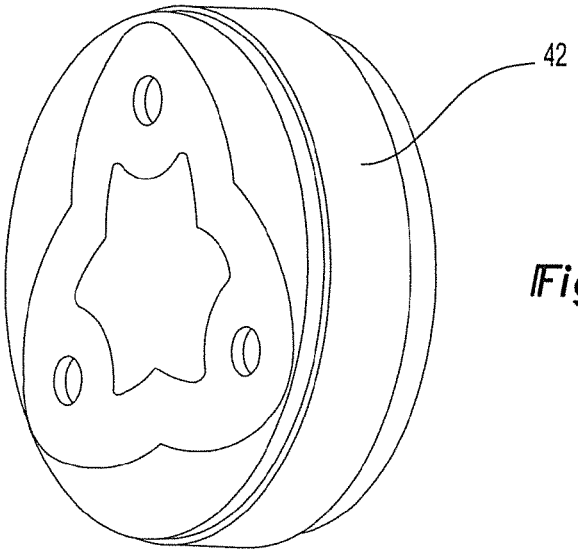
FIG. 8 illustrates a perspective view of the overmolded coupler of the present invention.
Figure 9:
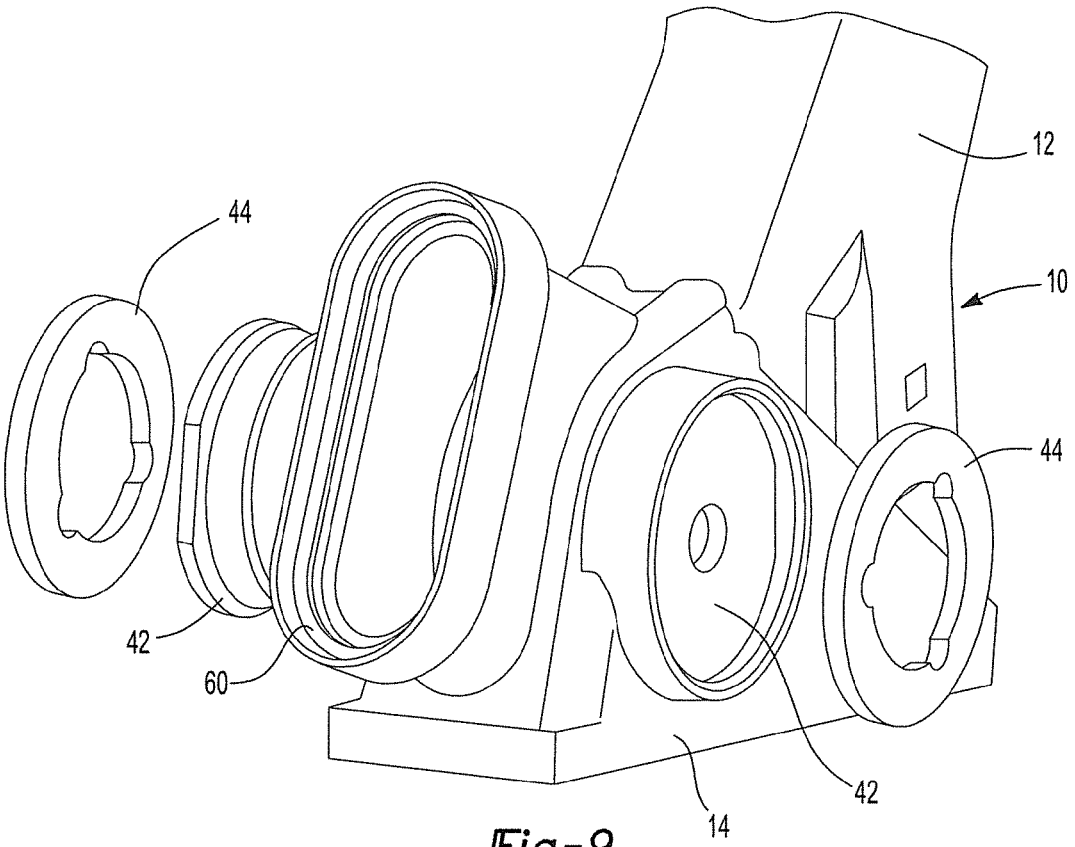
FIG. 9 illustrates an exploded perspective view of the connection of the sensor to the pedal arm where the sensor, the pedal arm and the housing are integrated.

In one embodiment, the housing 14 further includes a spring carrier 22 connected to a first spring 43 and a second spring 45. Other embodiments simply include the first spring 43 and the spring dampener 20. The spring dampener 20 has two sides 37, 41 having a smooth interior and a flat front surface 39. The two sides are separated from each other by a generally rectangular shaped gap and thus are only connected by a top surface 47. The spring dampener 20 configured to receive at least one spring 43 within the space between the two side walls 37, 41 and below the top surface 47. The spring carrier 22 is connected to the friction shoe 24. Both the spring carrier 22 and the friction shoe 24 are mounted to the housing 14. The housing 14 further includes an angled wall 35. The spring carrier 22 is mounted adjacent to and operable to slide down the angled wall 35 upon receiving of a force 32 from the spring 43. The two springs are mounted on the spring carrier 22. A first spring is mounted around a spring dampener 20. A second spring is mounted within the spring dampener 20. In the embodiment as shown in FIG. 7, the spring 43 is mounted within the spring dampener 20. In other embodiments, the spring 43 (as a single spring) is mounted abound the spring dampener 20.

The hysteresis subassembly 15 includes at least one spring 45 connecting to a spring carrier 22 wherein the spring is depressed upon depression of the pedal arm of the pedal assembly. As the spring 45 applies a force 32 to the spring carrier 22, the spring carrier 22 slides down an inclined wall 35 and applies a force 36 to a friction shoe 24. The friction shoe 24 is in contact with the generally circular hub 26 of the pedal arm 12 thus providing a hysteresis effect as the friction shoe 24 contacts the hub 26 of the pedal arm 12. Various other connection portions and sensor orientation is also provided within this disclosure.

The spring carrier 22 includes an upper surface 27 adapted to receive the springs 43, 45 and the spring dampener 20. The upper surface 27 includes a generally circular holding portion and a central protrusion 29 to keep the springs 43, 45 and the spring dampener in place. The spring carrier 22 further includes a protrusion 23 adapted to connect with the friction shoe 24. The friction shoe 24 includes corresponding geometry in the form of an indentation 33 adapted to accept the protrusion 23. The indentation 33 and protrusion 23 abut 31 in semi-arcuate in shape so not to encapsulate the protrusion 33 thus allowing the protrusion 33 to have limited freedom thereby allowing the friction shoe 24 and the carrier 22 to float together as a single piece with an ability to align with the spring force 32. The friction shoe 24 further includes an angled surface 25 adapted to connect with the hub 26 of the pedal arm.

The spring dampener 20 is operable to prevent the springs from touching and to prevent unwanted noise. As the springs and spring dampener 20 applies the spring force 32 to the spring carrier 22, the spring carrier moves down the angled wall as illustrated by force arrow 34. The spring carrier slides down the angled wall 35 and moves forward towards the friction shoe 24 as illustrated by the force arrow 36. As the spring carrier 22 and the friction shoe 24 move in a forward direction as illustrated by force arrow 36, the friction shoe 24 comes into contact with a hub 26 of the pedal arm 12. The hub 26 of the pedal arm has a generally circular outer surface. The friction shoe 24 includes an outer surface having complementary structure to the outer surface of the hub 26. As the user depresses the pedal arm 12 of the pedal assembly 10, a hysteresis effect is felt by the user due to the friction created between the hub 26 and the friction shoe 24. As the spring carrier 22 slides down the angled surface 35 it causes the friction shoe 24 to apply pressure to the hub 26 of the arm generating friction.

Figure 2:
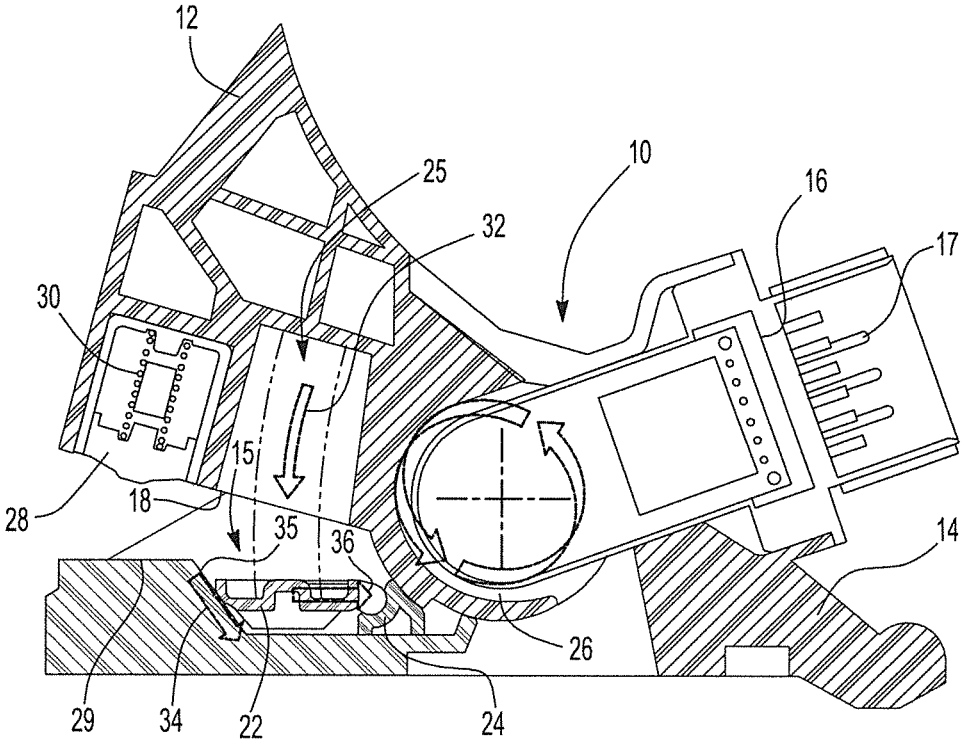
FIG. 2 illustrates a cross sectional view of the pedal assembly of the present invention utilizing directional arrows to illustrate the movement of the hysteresis system.
Figure 3:
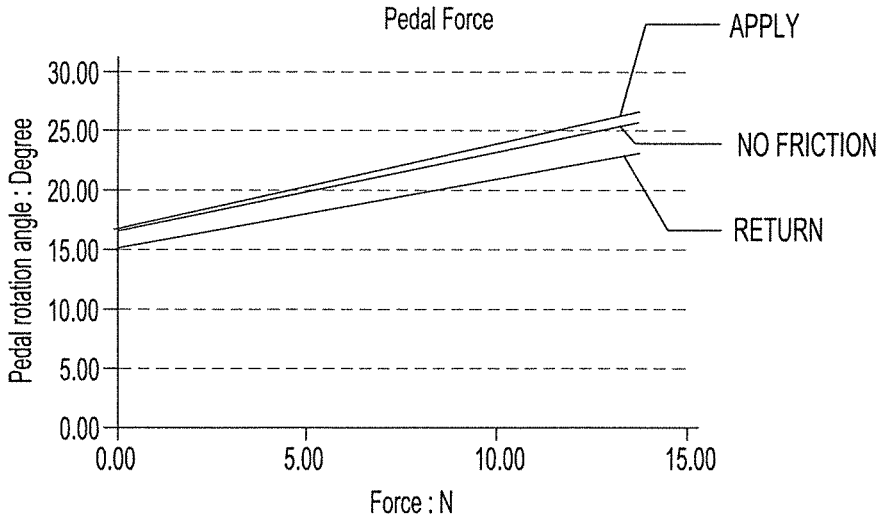
FIG. 3 illustrates a graphical representation of the force versus pedal rotation angle of the pedal assembly of the present invention.
Figure 4:
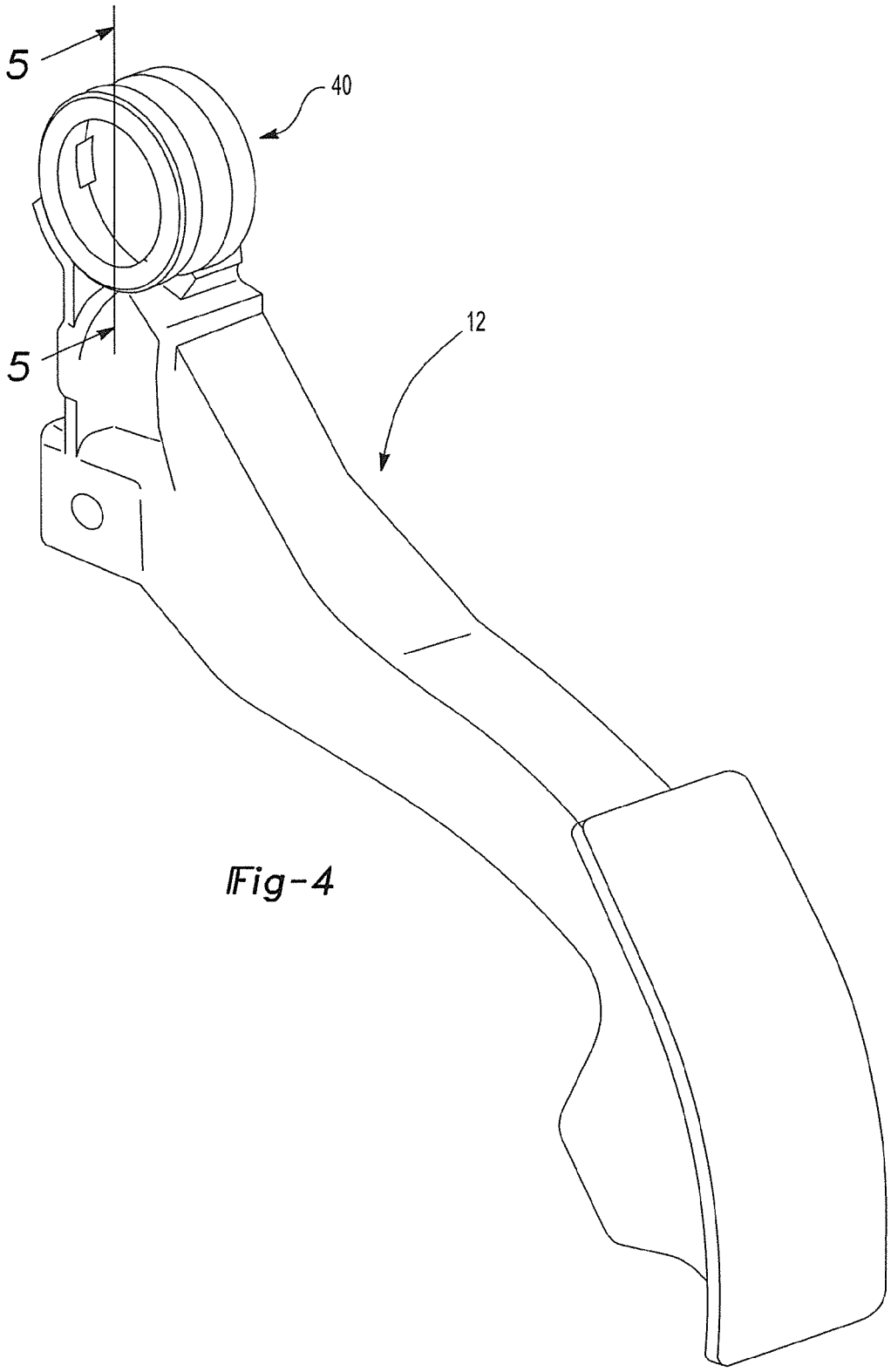
FIG. 4 illustrates the pedal arm of the present invention.

Friction is applied to the pedal hub 26 creating a hysteresis between the Apply and Return strokes. As illustrated in FIG. 2, as the pedal rotation angle increases, so does the force.

The at least one spring 45 rests within the spring carrier 22. The spring carrier 22 includes structure compatible with the friction shoe 24. The spring carrier 22 includes a generally rounded protrusion 23 operable to connect with a rounded surface indentation 33 of the friction shoe 24. The friction shoe further includes opposed connection structures. The friction shoe 24 includes an angled surface 25.

Figure 5:
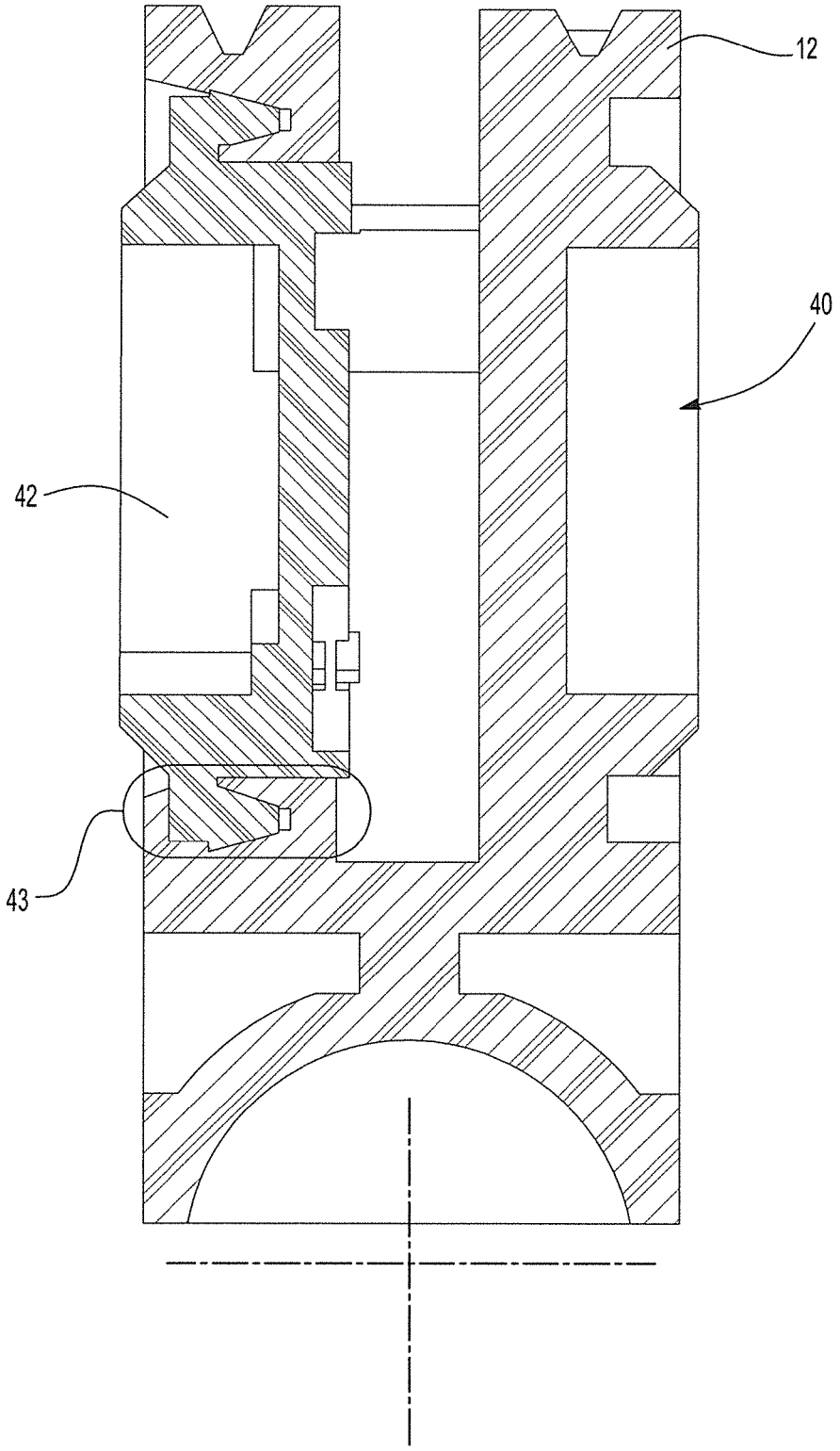
FIG. 5 illustrates the coupler of the present invention mounted within the hub of the pedal arm.
Figure 6:
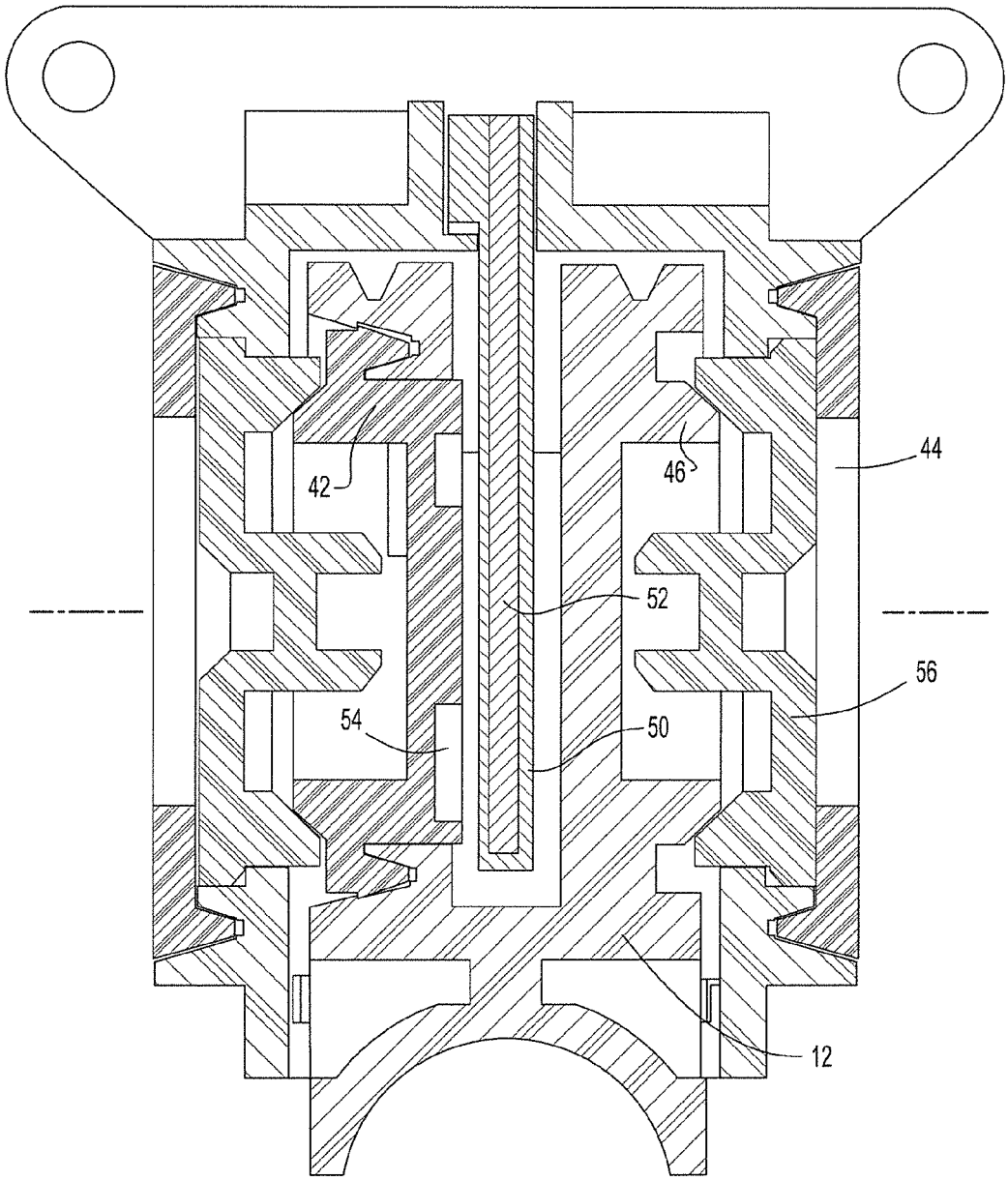
FIG. 6 illustrates a cross sectional view of the sensor, coupler, and pedal arm of the present invention.

The connection of the pedal arm 14 to the sensor having various bushings and couplers. FIGS. 5-6 illustrate the coupler insert 42 mounted to the pedal arm 12 wherein FIG. 5 illustrates a cross section of the coupler 40 taken from line 5. The pivot coupler 40 is illustrated in FIGS. 5-6. An insert 42 includes a spin weld engagement as illustrated at reference numeral 43. The coupler insert 42 may be overmolded with a plastic, plastic like, polymer or polymer like material for protection and for ease of installment. The coupler insert 42 is mounted to a free end of the pedal arm 12. FIG. 6 illustrates a cross section of the coupler 40 and the spin weld ring taken from line 5. The spin weld ring 44 is operable to connect to the housing 14 having the coupler insert 42 having the bushing 56 disposed between the spin weld ring 44 and the spin weld rotor insert 46. FIG. 6 illustrates the sensor 50 having a PCB (printed circuit board) 52 disposed within the pedal arm 12. A coupler 54 is further disposed positioned adjacent to the sensor 50. The coupler 54 is molded or heat staked to the coupler insert 42. The pedal arm 12 and the coupler insert 42 along with the bushing 56, the spin weld rotor insert 46 and the ring 44 are operable to connect in a snap fit engagement and connect to the housing 14.

The sensor 50 having the PCB board 52 is operable to measure the rotation of the pedal arm 12. The sensor 50 is operable also to measure the electrical hysteresis. Force gauges (not shown) are operable to measure the friction created between the hub 26 and the friction shoe 24. Information regarding rotation and friction is sent to an ECU or processor (not shown) through the connector 16 housing the sensor 56.

An electronic throttle control pedal assembly for use with a vehicle producing hysteresis, the assembly includes a pedal arm pivotally connected to a housing, the housing having a sensor mounted between an end of the pedal arm and the housing configured to measure rotational movement of the pedal arm during depression of the pedal arm, the pedal arm having an outer surface. The assembly further includes a hysteresis subassembly mounted to the housing, the hysteresis subassembly having a friction shoe and a spring carrier both mounted to spring carrier, the spring carrier configured to slide along the angled wall, the outer surface of the pedal arm in contact with an outer surface of the friction shoe, at least one spring mounted between the spring carrier and the pedal arm. As the pedal arm is depressed, the spring displaces the spring carrier along the angled wall which in turn pushes the friction shoe against the pedal arm as the pedal arm continues to rotate thereby creating friction and thus creating hysteresis between the angled surface and the spring carrier and between the friction shoe and the pedal arm.

The pedal arm may include an indentation portion to contain the at least one spring. The pedal arm further includes a kick down button adapted to contact a second surface of the housing, the kick down button configured to send a signal to an ECU when the kick down contacts the second surface of the housing to indicate that the pedal has been fully depressed. The kick down button includes a spring.

The electronic throttle control pedal assembly may include the sensor being a rotational sensor having a coupler insert mounted to a free end of the pedal arm. The coupler insert includes a spin weld engagement. The sensor includes a spin weld ring configured to connect to the housing. The sensor may include a printed circuit board mounted within the pedal arm.

Further, two total springs may be provided mounted between the spring carrier and the housing. A spring dampener is positioned between the two springs to prevent the two springs from touching thereby preventing noise.

The spring carrier includes a generally circular indentation adapted to connect with the at least one spring. The generally circular indentation of the spring carrier includes a protrusion extending upwards towards the spring configured to assist in mounting of the spring to the spring carrier.

FIG. 7 illustrates an overmolded coupler 42 for incorporation into the hib (pivot point) of the pedal assembly. The coupler 42 may include the sensor (or components of the sensor) for incorporation into the hub.

The outer surface of the friction shoe is generally rounded and adapted to connect with the generally rounded outer surface of the pedal arm. The spring carrier moves downwards and forward towards the end of the pedal arm as the pedal arm is depressed, the spring carrier forces the friction shoe against the pedal arm thereby producing hysteresis.

The first end of the pedal arm includes a generally circular connector adapted to connect to the housing. The spring carrier includes a rounded protraction extending towards the free end of the pedal arm configured to connect with a generally rounded indentation of the friction shoe. Further, the sensor may include a connector adapted to connect to an ECU.

An electronic throttle control pedal assembly is provided having a housing, a pedal arm rotationally connected to the housing, the pedal arm having a hub at a distal end of the pedal arm where the pedal arm connects to the housing and a sensor incorporated within the hub of the pedal arm wherein the sensor is configured to measure rotational movement of the pedal arm. The sensor incorporated within the hub is clearly illustrated in FIGS. 2, 5-6 and 8-9. The sensor incorporated within the housing is beneficial in that cost and packaging space is dramatically reduced. Since the housing and pedal arm are made of a molded plastic, it is now easier to manufacture the assembly having the sensor incorporated within the hub. This configuration was not possible before with traditional pedal assemblies. The electronic throttle control pedal further provides for the housing having a hysteresis subassembly in communication with the hub of the pedal arm. The housing includes an indentation configured to accept a portion of the hysteresis subassembly.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art.

The invention claimed is:

1. An electronic throttle pedal assembly for use with a vehicle producing hysteresis, the assembly comprising:

a housing having a first surface with an angled wall portion and a second surface having a generally planner portion;

a pedal arm pivotally connected to the housing, the pedal arm having an outer surface, the outer surface having a generally circumferential shape;

a hysteresis subassembly mounted to the housing, the hysteresis subassembly having a friction shoe and a spring carrier both mounted to the housing, the spring carrier having a rounded protrusion extending towards a free end of the pedal arm, the friction shoe having an arcuate indentation configured to receive the spring carrier rounded protrusion, the spring carrier configured to slide along the angled wall portion, the outer surface of the pedal arm in contact with an outer surface of the friction shoe, together the friction shoe and the spring carrier move as a single unit to prevent relative rotation of the spring carrier with respect to the movement of one another, the hysteresis subassembly having at least one spring mounted between the spring carrier and the pedal arm;

wherein as the pedal arm is depressed, the at least one spring displaces the spring carrier along the along the angled wall portion which in turn pushes the friction shoe against the pedal arm as the pedal arm continues to rotate thereby creating friction and thus creating hysteresis between the angled wall portion and the spring carrier and between the friction shoe and the pedal arm.

2. The electronic throttle control pedal assembly of claim 1 wherein the pedal arm includes an indentation portion to contain the at least one spring.

3. The electronic throttle control pedal assembly of claim 1 wherein the pedal arm further includes a kick down button adapted to contact the second surface of the housing, the kick down button configured to send a signal to an electronic control unit when the kick down button contacts the second surface of the housing to indicate that the pedal has been fully depressed.

4. The electronic throttle control pedal assembly of claim 3 wherein the kick down button includes a spring.

5. The electronic throttle control pedal assembly of claim 1 having a sensor wherein the sensor is a rotational sensor having a coupler insert mounted to the free end of the pedal arm.

6. The electronic throttle control pedal assembly of claim 5 wherein the coupler insert includes a spin weld engagement.

7. The electronic throttle control pedal assembly of claim 5 wherein the sensor includes a spin weld ring configured to connect to the housing.

8. The electronic throttle control pedal assembly of claim 1 having a sensor wherein the sensor includes a printed circuit board mounted within the pedal ann.

9. The electronic throttle control pedal assembly of claim 1 wherein the at least one spring is comprised of two total springs mounted between the spring carrier and the housing.

10. The electronic throttle control pedal assembly of claim 9 wherein a spring dampener is positioned between the two springs to prevent the two springs from touching thereby preventing noise.

11. The electronic throttle control pedal assembly of claim 1 wherein the spring carrier includes a generally circular indentation adapted to connect with the at least one spring.

12. The electronic throttle control pedal assembly of claim 11 wherein the generally circular indentation of the spring carrier includes a protrusion extending upwards towards the at least one spring configured to assist in mounting of the at least one spring to the spring carrier.

13. The electronic throttle control pedal assembly of claim 1 wherein the outer surface of the friction shoe is arcuate and adapted to connect with the circumferential outer surface of the pedal arm.

14. The electronic throttle control pedal assembly of claim 1 wherein the spring carrier moves downwards and forward towards a hub of the pedal arm as the pedal arm is depressed, the spring carrier forces the friction shoe against the pedal arm thereby producing hysteresis.

15. The electronic throttle control pedal assembly of claim 1 wherein a first end of the pedal arm includes a generally circular connector adapted to connect to the housing.

16. The electronic throttle control pedal assembly of claim 1 having a sensor wherein the sensor includes a connector adapted to connect to an electronic control unit.

17. The electronic throttle control pedal assembly of claim 16 wherein the sensor is provided connected through a pivot point of the pedal arm where the pedal arm connects to the housing of the pedal assembly.

18. The electronic throttle control pedal assembly of claim 1 wherein the housing includes a sensor mounted between an end of the pedal arm and the housing configured to measure rotational movement of the pedal arm during depression of the pedal arm.

19. An electronic throttle control pedal assembly comprising:

a housing;

a pedal arm rotationally connected to the housing, the pedal arm having a hub at a distal end of the pedal arm where the pedal arm connects to the housing; and a sensor incorporated within the hub of the pedal arm wherein the sensor is configured to measure rotational movement of the pedal arm, wherein the sensor includes a coupler insert mounted to a free end of the pedal arm and a spin weld ring configured to connect to the housing.

20. The electronic throttle control pedal assembly of claim 19 wherein the housing further includes a hysteresis subassembly in communication with the hub of the pedal arm.

21. The electronic throttle control pedal assembly of claim 20 wherein the housing includes an indentation configured to accept a portion of the hysteresis subassembly.

* * * * *